US008241557B2

(12) United States Patent
Sugiyama et al.

(10) Patent No.: US 8,241,557 B2
(45) Date of Patent: Aug. 14, 2012

(54) METHOD FOR PRODUCING DUST CORE

(75) Inventors: Masaki Sugiyama, Miyoshi (JP); Toshiya Yamaguchi, Miyoshi (JP); Shinjiro Saigusa, Toyota (JP); Mitsutoshi Akiyama, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/188,638

(22) Filed: Jul. 22, 2011

(65) Prior Publication Data

US 2011/0274576 A1 Nov. 10, 2011

Related U.S. Application Data

(63) Continuation of application No. PCT/JP2009/051046, filed on Jan. 23, 2009.

(51) Int. Cl.
*B22F 1/02* (2006.01)
*B22F 3/12* (2006.01)

(52) U.S. Cl. ..... 419/35; 419/38; 148/104

(58) Field of Classification Search ..... 419/35, 419/44; 149/104; 148/104
See application file for complete search history.

(56) References Cited

U.S. PATENT DOCUMENTS

| | | | | |
|---|---|---|---|---|
| 7,235,208 | B2 * | 6/2007 | Moro | 264/328.14 |
| 2002/0014280 | A1 * | 2/2002 | Moro | 148/104 |
| 2003/0077448 | A1 | 4/2003 | Ueta et al. | |
| 2006/0118207 | A1 * | 6/2006 | Yoshizawa | 148/307 |

FOREIGN PATENT DOCUMENTS

| | | | |
|---|---|---|---|
| JP | 2003-303711 | A | 10/2003 |
| JP | 2005-146315 | A | 6/2005 |
| JP | 2008-136185 | A | 6/2008 |
| JP | 2008-235525 | A | 10/2008 |
| JP | 2008-262944 | A | 10/2008 |

OTHER PUBLICATIONS

International Search Report, mailed Apr. 28, 2009 of PCT/JP2009/051046.

* cited by examiner

*Primary Examiner* — Roy King
*Assistant Examiner* — Ngoclan T Mai
(74) *Attorney, Agent, or Firm* — Kenyon & Kenyon LLP

(57) ABSTRACT

An object of the present invention is to provide a method for producing a dust core wherein generation of iron oxide at grain boundaries in the dust core is unlikely to take place upon annealing of the dust core subjected to compaction, thus allowing excellent electromagnetic characteristics to be realized. Also, the following is provided: a method for producing a dust core, which comprises: a step of molding a magnetic powder comprising a powder for a dust core formed with an iron-based magnetic powder coated with a silicone resin into a dust core via compaction; and a step of annealing the dust core via heating so as to cause the silicone resin contained in the dust core to be partially formed into a silicate compound, wherein annealing of the dust core is carried out at a dew point of an inert gas of −40° C. or lower in an inert gas atmosphere in the annealing step.

2 Claims, 8 Drawing Sheets

(a)

(b)

(c)

(a)

(b)

(a)

(b)

METHOD FOR PRODUCING DUST CORE

This is a PCT By-Pass Continuation of PCT/JP2009/051046 filed 23 Jan. 2009, the contents of which are incorporated herein by reference.

TECHNICAL FIELD

The present invention relates to a method for producing a dust core, which comprises compacting a magnetic powder comprising a powder for a dust core wherein the surface of each magnetic powder particle is at least coated with an insulating layer. In particular, the present invention relates to a method for producing a dust core whereby magnetic characteristics can be improved.

BACKGROUND ART

Hitherto, alternating magnetic fields have been used for magnetic devices using electromagnetic force such as transformers, electric motors, and power generators. In general, an alternating magnetic field is formed using a coil in the center of which a magnetic core is placed. In order to improve performance of a magnetic device or to reduce the size thereof, it is important for such magnetic core to have improved magnetic characteristics.

Therefore, for instance, in order to allow a magnetic core to have improved capacity to be molded or a reduced size depending on the magnetic device part, a dust core is used as a magnetic core in some cases. In a method for producing a dust core, first, a magnetic powder comprising a powder for a dust core, which is obtained by coating magnetic powder particles of iron or the like with an insulating layer consisting of a polymer resin such as a silicone resin, is prepared or produced. Next, the magnetic powder is introduced into a molding die and subjected to compression molding (compaction) under certain pressure conditions. Thereafter, in order to reduce iron loss (hysteresis loss) and the like, the dust core subjected to compression molding is subjected to annealing. In the case of the thus obtained dust core, eddy-current loss can be reduced with an increase in specific resistance by forming an insulating film. In addition, since a high-density dust core is obtained, magnetic characteristics, such as those relating to the magnetic flux density, can be improved.

For example, as a method for producing a dust core, a method for producing a dust core comprising: producing a powder for a dust core by subjecting a magnetic powder mainly consisting of iron (Fe) and silicon (Si) to heat treatment in an oxygen atmosphere at a dew point of −30° C. to 65° C. so as to form an insulating film on each magnetic powder particle; subjecting a magnetic powder comprising the powder for a dust core to compression molding; and carrying out annealing treatment in a nitrogen atmosphere (i.e., in a non-oxygen atmosphere) has been suggested. (See, for example, Patent Document 1.)

Patent Document 1: JP Patent Publication (Kokai) No. 2005-146315 A

DISCLOSURE OF THE INVENTION

Problem to be Solved by the Invention

It has been found that insulation between magnetic particles is inhibited in the presence of iron oxide, even in cases in which dust cores are produced by the method disclosed in Patent Document 1. Such iron oxide is generated (at a grain boundary) between magnetic particles of the dust core (particles of a compression-deformed magnetic powder) upon annealing of the molded dust core.

The present invention has been made in view of the above problems. An object of the present invention is to provide a method for producing a dust core wherein generation of iron oxide at grain boundaries in the dust core is unlikely to take place upon annealing of the dust core subjected to compaction, thus allowing excellent electromagnetic characteristics to be realized.

As a result of intensive studies in order to achieve the object, the present inventors newly discovered that generation of iron oxide between magnetic particles of a dust core upon annealing following compaction is determined by the dew point upon annealing.

The present invention is based on the above finding of the present inventors. The method for producing a dust core of the present invention is a method for producing a dust core, which comprises: a step of molding a dust core by compacting a magnetic powder comprising a powder for a dust core that is formed with iron-based magnetic powder particles coated with a silicone resin; and a step of annealing the dust core via heating so as to cause the silicone resin contained in the dust core to be partially formed into a silicate compound after the molding step, wherein annealing of the dust core is carried out at a dew point of an inert gas of −40° C. or lower in an inert gas atmosphere in the annealing step.

According to the present invention, in the annealing step, the dew point of an inert gas is determined to be −40° C. or lower in an atmosphere of an inert gas such as a nitrogen gas. Thus, an increase in iron loss can be inhibited. In addition, generation of iron oxide between magnetic particles of a molded magnetic powder can be inhibited. As a result, conduction between magnetic particles is inhibited, allowing the improvement of dust core electromagnetic characteristics. Specifically, when the dew point of an inert gas exceeds −40° C. in an inert gas atmosphere, dust core electromagnetic characteristics tend to be inhibited due to generation of iron oxide as described above. Further, a silicone resin is caused to form a silicate compound containing Si and O (and also containing $SiO_2$) in the annealing step. Accordingly, dust core insulation resistance can be further improved.

The term "dew point" (or dew point temperature) used in the present invention refers to a temperature at which water vapor in a gas is saturated to form dew droplets. For example, it refers to the ambient temperature at a relative humidity of 100%. When the moisture content in an inert gas in an inert gas atmosphere is low, the dew point temperature decreases. On the other hand, when the moisture content in an inert gas is high, the dew point temperature increases. Specifically, the dew point is an indicator showing the moisture content in an inert gas in an inert gas atmosphere. Therefore, there is no relationship between the dew point temperature and the temperature of an inert gas itself. Preferably, the dew point temperature is measured at a gas pressure of 1 atmosphere at an inlet and an outlet of an inert gas to be introduced into or discharged from a furnace used for heat treatment. The term "dew point" used in the present invention refers to a value obtained at 1 atmosphere (0.1 MPa).

In addition, in the method for producing a dust core of the present invention, it is preferable to carry out annealing of a dust core by heating the dust core under heating conditions of 500° C. to less than 900° C. in the annealing step.

According to the present invention, when the temperature for heating a dust core is determined to be 500° C. or higher and the dew point in an inert gas atmosphere is determined to be −40° C. or lower in the annealing step, a silicone resin is partially formed into a silicate compound with improved certainty and generation of iron oxide between magnetic particles of a compacted magnetic powder can be inhibited. Thus, magnetic characteristics of a dust core can be improved.

Specifically, even if annealing of a dust core is carried out while maintaining the dew point of an inert gas at −40° C. or lower in a heating temperature region of less than 500° C., when the dew point of an inert gas becomes −40° C. or higher in a heating temperature region of 500° C. or higher, generation of iron oxide takes place. Further, in some cases, when the heating temperature is 900° C. or higher, a silicate compound is destroyed, resulting in increased iron loss in a dust core.

The term "heating condition(s)" used in the present invention refers to target heating temperature conditions for annealing of a dust core. It includes heat treatment temperature that is increased to a target heating temperature and then maintained for a certain period of time for stably heating a dust core in a conventional case.

The term "magnetic powder" used in the present invention refers to a powder having magnetic permeability. It is preferably a soft iron-based magnetic metal powder. Examples of metals to be used for such powder include iron (pure iron), an iron-silicon-based alloy, an iron-nitrogen-based alloy, an iron-nickel-based alloy, an iron-carbon-based alloy, an iron-boron-based alloy, an iron-cobalt-based alloy, an iron-phosphorus-based alloy, an iron-nickel-cobalt-based alloy, and an iron-aluminum-silicon-based alloy. In addition, examples of magnetic powders include a water atomized powder, a gas-atomized powder, and a pulverized powder. In consideration of prevention of destruction of an insulating layer consisting of a silicone resin upon compaction, it is preferable to select a powder consisting of particles each having substantially no irregular surface. In addition, the average particle size of a magnetic powder particle is preferably 10 to 450 μm.

For example, according to the method for coating a silicone resin used in the present invention, a magnetic powder is introduced into a solution obtained by diluting a silicone resin with an organic solvent, the powder is mixed with the solution by stirring, and the solution is evaporated for drying. Thus, coating of a magnetic powder can take place. However, the method is not particularly limited as long as it is a method whereby an insulating layer consisting of a silicone resin can be uniformly and homogeneously applied for coating.

In addition, an example of an inert gas used in the present invention is a nitrogen gas. Such gas may contain a hydrogen gas. It is not particularly limited as long as it is a gas with which annealing can be carried out in an oxygen-free atmosphere so as to inhibit dust core oxidation in the annealing step.

Also, according to the method for producing a dust core of the present invention, it is preferable to fill a molding die with a magnetic powder comprising a powder for a dust core and to carry out compaction by a warm compaction method with die lubrication. When the powder is compacted into dust core by a warm compaction method with die lubrication, it becomes possible to mold the powder into a dust core at pressures higher than pressures used for conventional room temperature molding.

The aforementioned dust core having excellent insulation and electromagnetic characteristics is preferably used for stators and rotors constituting electric motors for driving hybrid vehicles and electric vehicles and cores (reactor cores) for reactors constituting power transducers.

Effects of the Invention

According to the present invention, oxide generation at grain boundaries in a dust core is unlikely to take place upon annealing of a dust core obtained via compaction. Therefore, a dust core having excellent electromagnetic characteristics can be obtained.

BRIEF DESCRIPTION OF THE DRAWINGS

FIG. 1(*a*) schematically shows a powder for a dust core used in one embodiment of the present invention. FIG. 1(*b*) illustrates a step of molding a powder into a dust core. FIG. 1(*c*) illustrates a step of annealing a dust core.

FIG. 3(*a*) is a chart showing inductance measurement results. FIG. 3(*b*) is a chart showing AC (alternate current) resistance measurement results.

FIG. 6(*a*) shows inductance measurement results. FIG. 6(*b*) shows AC resistance measurement results.

FIG. 7(*a*) is a chart showing inductance measurement results. FIG. 7(*b*) is a chart showing AC resistance measurement results. FIG. 7(*c*) is a chart showing iron loss determination results. FIG. 7(*d*) is a chart showing radial crushing strength determination results.

DESCRIPTION OF SYMBOLS

2 . . . Magnetic powder; 3 . . . Polymer resin insulating layer; 4 . . . Powder for dust core; 10 . . . Dust core; 30 . . . Molding die; 41 . . . Nitrogen gas supply source; 42 . . . Dew point controller; 43 . . . Dew point meter; 44 . . . Dew point meter; 51 . . . Heating furnace; 52 . . . Heater; 53 . . . Thermometer

BEST MODE FOR CARRYING OUT THE INVENTION

Embodiments of the method for producing a dust core of the present invention are described below with reference to the drawings.

Figure 1:
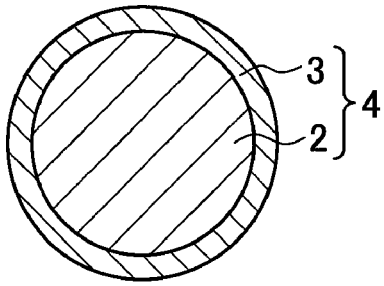
FIGS. 1(*a*) to 1(*c*) illustrate the method for producing a dust core used in one embodiment of the present invention.
Figure 1:
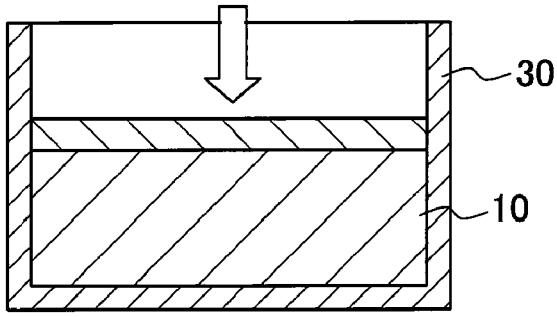
Figure 1:
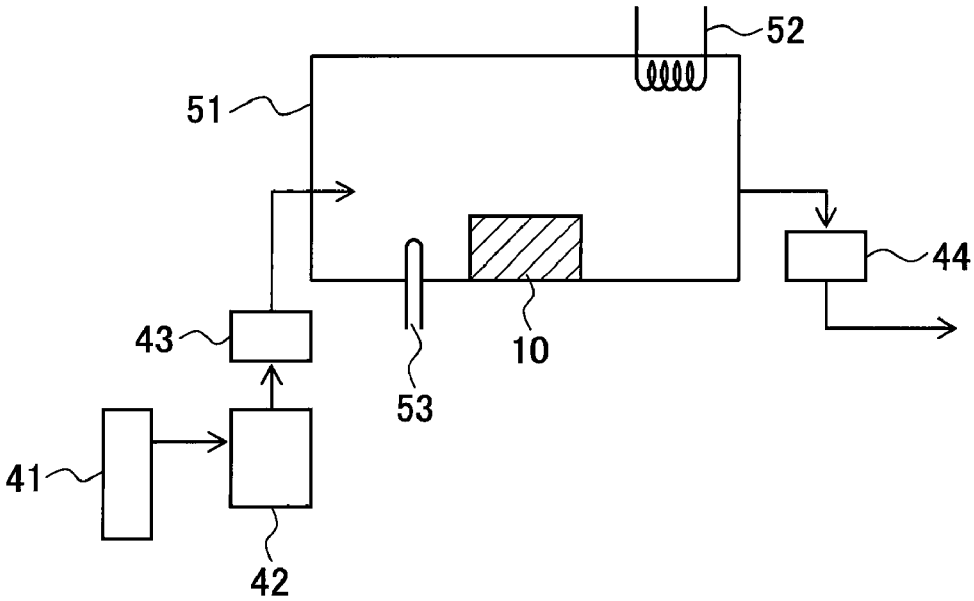

FIGS. 1(*a*) to 1(*c*) illustrate the method for producing a dust core used in one embodiment of the present invention. FIG. 1(*a*) schematically shows a powder for a dust core used in one embodiment of the present invention. FIG. 1(*b*) illustrates a step of molding a powder into a dust core. FIG. 1(*c*) illustrates a step of annealing a dust core.

As shown in FIG. 1(*a*), a powder for a dust core 4 to be molded into a dust core is obtained by coating particles of a magnetic powder 2 with a polymer resin insulating layer 3. A magnetic powder 2 is an iron-based powder. Specifically, it is an iron-silicon-based alloy powder obtained by alloying iron and silicon or an iron-aluminum-silicon-based alloy powder.

Such magnetic powder 2 is an atomized powder with an average particle size of 10 to 450 μm produced via gas atomization or water atomization, or it is a pulverized powder obtained by pulverizing an alloy ingot using a ball mill or the like.

A polymer resin insulating layer 3 is a layer consisting of a polymer resin used for securing electric insulation between magnetic particles (of a molded magnetic powder) contained in a dust core 10. Examples of a polymer resin include a polyimide resin, a polyamide resin, an aramid resin, and a silicone resin. In this embodiment, it is a layer consisting of a silicone resin. Such polymer resin insulating layer 3 can be obtained by, for example, adding a magnetic powder 2 to a solution obtained by diluting a silicone resin with an organic solvent, mixing the powder with the solution, and drying the resulting solution.

Next, a molding die 30 is filled with a magnetic powder comprising a powder for a dust core 4 shown in FIG. 1(*a*) (an aggregate formed with a powder for a dust core 4) as shown in FIG. 1(*b*). A dust core 10 is obtained by carrying out a step of molding the magnetic powder via compaction. A magnetic powder to fill a molding die 30 may be a powder obtained by adding a silane-based coupling agent, a different insulating agent, or the like to the powder for a dust core. Compaction of the magnetic powder filling the molding die can be carried out by a conventional cold, warm, or hot molding method using a powder mixed with an internal lubricant or the like. However, in order to improve magnetic characteristics through formation of a high-density dust core, the powder is molded into a dust core 10 by a warm compaction method with die lubrication in this embodiment. In this case, even if molding pressure is increased, scoring does not take place between the internal surface of a molding die and a magnetic powder, and decompression pressure is not excessively increased. Accordingly, reduction of the molding die life can be prevented. In addition, a high-density dust core can be mass-produced at an industrial level, rather than at an experimental level.

The extent of pressure in the molding step is adequately determined depending on specifications, production equipment, and the like for a dust core. However, when a warm compaction method with die lubrication is used, molding can be performed under high pressures exceeding conventional molding pressures. Therefore, even if a hard Fe—Si-based magnetic powder described in this embodiment is used, a high-density dust core can be readily obtained. For example, preferably, the molding pressure is determined to be 980 to 2000 MPa.

In the molding step shown in FIG. 1(*b*), when a powder for a dust core is subjected to compaction, residual stress and residual distortion are generated inside a molded dust core. In order to remove such stress and distortion, an annealing step of heating and gradually cooling a dust core is carried out after the molding step shown in FIG. 1(*c*).

Specifically, as shown in FIG. 1(*c*), a dust core 10 is placed in a heating furnace 51. A nitrogen gas is supplied to the furnace from a nitrogen gas supply source 41 filled with a nitrogen gas. The temperature inside the furnace is increased using a heater 52. Based on the measurement temperature shown by a thermometer 53 placed in the heating furnace 51, the temperature for heating the dust core 10 is controlled.

In this embodiment, when the temperature inside the heating furnace 51 is increased, it is important to control the dew point (dew point temperature) of the atmosphere in the furnace. Preferably, the inside of the furnace is vacuum evacuated before introduction of a nitrogen gas. In addition, a nitrogen gas at a dew point controlled by a dew point controller 42 is introduced into the furnace from the nitrogen gas supply source 41 via the dew point controller 42 and a dew point meter 43. In addition, in this embodiment, a dew point meter 44 is placed on the outlet side of a heating furnace 51. The dew point is controlled in a manner such that the dew point measured by the dew point meter 43 at the inlet side and that measured by the dew point meter 44 at the outlet side become substantially equivalent. In addition, the dew point is defined as the temperature at which water vapor in a nitrogen gas starts to condense into dew droplets. The dew point is specified for a nitrogen gas subjected to dew point control at 1 atmosphere.

Figure 2:
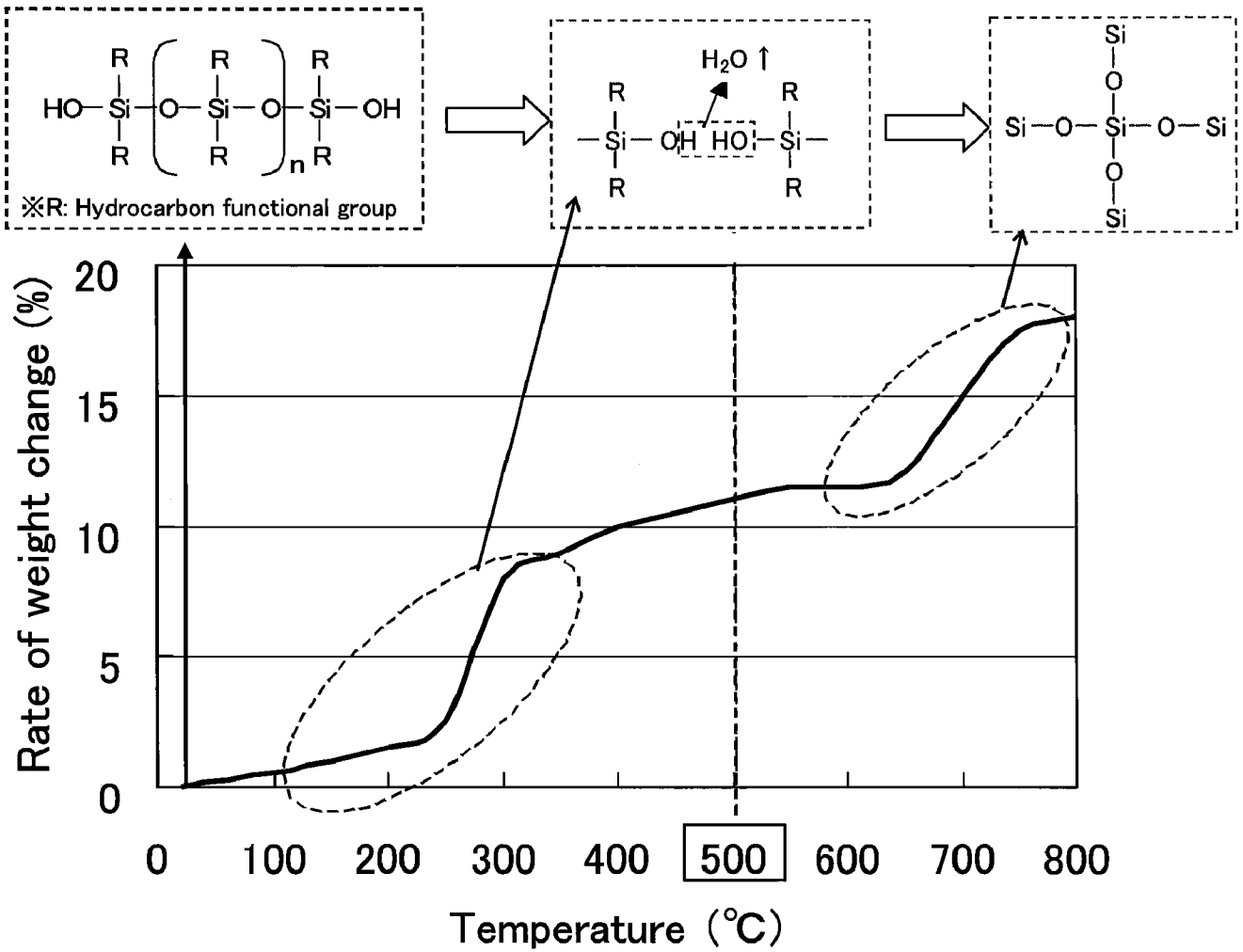
FIG. 2 is a chart illustrating a phenomenon by which a silicate compound is generated from a silicone resin under heat treatment conditions.

In this embodiment, a polymer resin insulating layer consisting of a silicone resin is formed. As shown in FIG. 2, this silicone resin undergoes a dehydration/condensation reaction at a heating temperature of approximately 200° C. to 300° C. in the annealing step, resulting in desorption of a hydroxyl group (—OH) from the silicone resin. Further, when the heating temperature is set at 500° C. or higher, desorption of a hydrocarbon functional group such as a methyl group takes place. Accordingly, the silicone resin is mineralized to form a silicate compound. As a result of formation of this silicate compound, insulation characteristics of the dust core can be realized with certainty.

However, when heating is carried out to generate a silicate compound, iron-based oxide might be generated between iron-based magnetic particles (particles of a compacted magnetic powder) inside the dust core 10 under such heating temperature conditions.

Therefore, in this embodiment, annealing of a dust core is carried out in a nitrogen gas atmosphere at a nitrogen gas dew point of −40° C. or lower. Specifically, the dew point in a furnace is controlled using dew point meters 43 and 44. In addition, the dew point of a nitrogen gas to be introduced into the furnace is controlled using the dew point controller 42. A method for controlling the dew point may be a conventional method whereby humidity (moisture) in a nitrogen gas can be removed, but it is not particularly limited thereto.

Further, in the state in which the dew point is controlled, annealing of a dust core 10 is carried out at the annealing step at a heat treatment temperature of 500° C. to less than 900° C. Accordingly, dust core coercive force is reduced, resulting in reduction of hysteresis loss. In addition, a dust core having an excellent capacity to follow an alternating magnetic field can be obtained. Here, residual distortion or the like removed in the annealing step may be distortion or the like accumulated inside particles of a magnetic powder before the molding step.

Furthermore, when the heat treatment temperature (heating temperature) is set to 500° C. or higher, a silicone resin is partially formed into a silicate compound. However, no iron-based oxide is generated between magnetic particles. In addition, the higher the heat treatment temperature, the more effective the removal of residual distortion or the like.

However, when the heat treatment temperature is 900° C. or higher, an insulating film comprising a silicate compound is at least partially destroyed. Therefore, the heat treatment temperature is set to 500° C. to less than 900° C. Thus, both removal of residual distortion and insulating film protection can be achieved. In view of advantageous effects and economic efficiency, the heating time (isothermal period) is 1 to 300 minutes and preferably 5 to 60 minutes.

In the case of the thus obtained dust core 10, AC resistance and iron loss can be reduced. Further, it is possible to achieve inductance within a desirable range that can be practically applied to magnetic devices. Thus, magnetic characteristics favorable for magnetic devices can be realized.

In addition, such dust core can be used for, for example, a variety of magnetic devices such as motors (and particularly cores or yokes), actuators, transformers, induction heaters (IH), and speakers. In particular, with the use of the dust core consisting of a coated magnetic powder of the present invention, high-magnetic flux density can be achieved. In addition, hysteresis loss can be reduced as a result of annealing. Therefore, it is effectively used for devices and apparatuses used in relatively low-frequency ranges.

EXAMPLES

The method for producing a dust core of the present invention is described below with reference to the following examples.

Example 1

An Fe-3% Si atomized powder (average particle size: 100 μm) was prepared. The atomized powder was added to a solution obtained by diluting a given amount of a commercially available silicone-based resin (1 mass %) with an organic solvent containing ethanol or the like. The powder was mixed with the solution by stirring and the resultant was dried. Thus, a silicone resin-coated powder for a dust core was produced.

Next, a molding step was carried out. Specifically, a given amount of a magnetic powder comprising the thus produced powder for a dust core was prepared. Water-dispersible lithium stearate was sprayed onto the surface of a U-shaped core molding die. The molding die was filled with the magnetic powder, followed by compaction by a warm compaction method with die lubrication at a molding pressure of 980 to 1568 MPa (and specifically 1176 MPa) and a molding die temperature of 120° C. to 150° C. (and specifically 135° C.). Accordingly, a dust core with a density of 7.0 to 7.3 g/cm$^3$ (and specifically 7.2 g/cm$^3$) was obtained.

Next, an annealing step was carried out. Specifically, residual distortion of the dust core obtained via compaction was corrected. In order to form a silicate compound from a silicone resin, heat treatment was performed at 750° C. for 30 minutes in an atmosphere of an inert gas (nitrogen gas) with the use of a heating furnace as shown in FIG. 1(*c*).

The dew point of nitrogen gas upon heat treatment was adjusted to −40° C. or less (−40° C., −50° C., or −60° C.) in a nitrogen gas atmosphere in the furnace by adding moisture to a nitrogen gas with a dew point of −60° C. or less.

Figure 3:
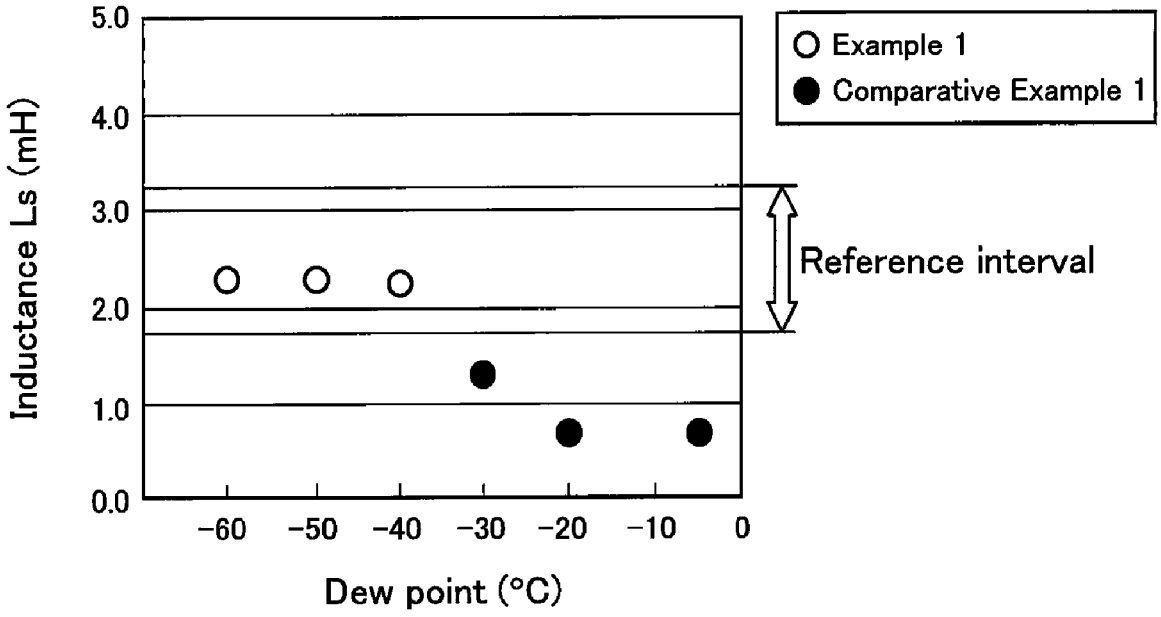
FIGS. 3(*a*) and 3(*b*) each show a chart indicating magnetic characteristics confirmed in Example 1 and Comparative Example 1.
Figure 3:
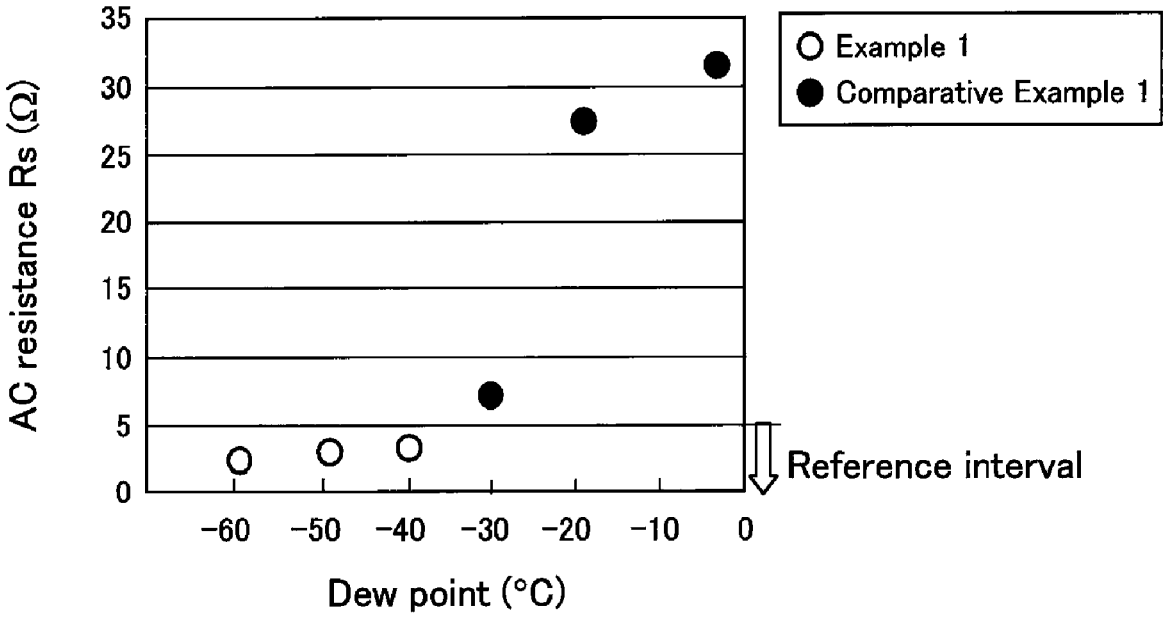
Figure 4:
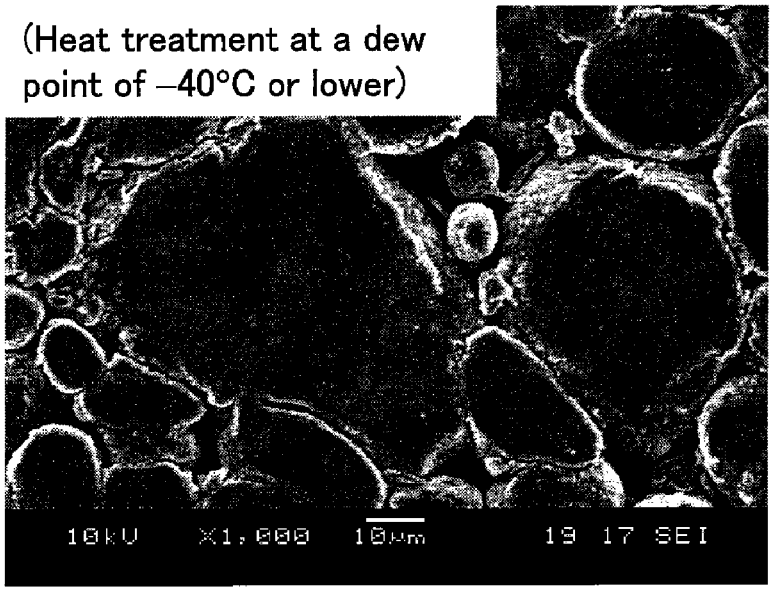
FIGS. 4(*a*) and 4(*b*) show a scanning electron microscopic image of tissue of the dust core observed in Example 1 and that observed in Comparative Example 1, respectively.
Figure 4:
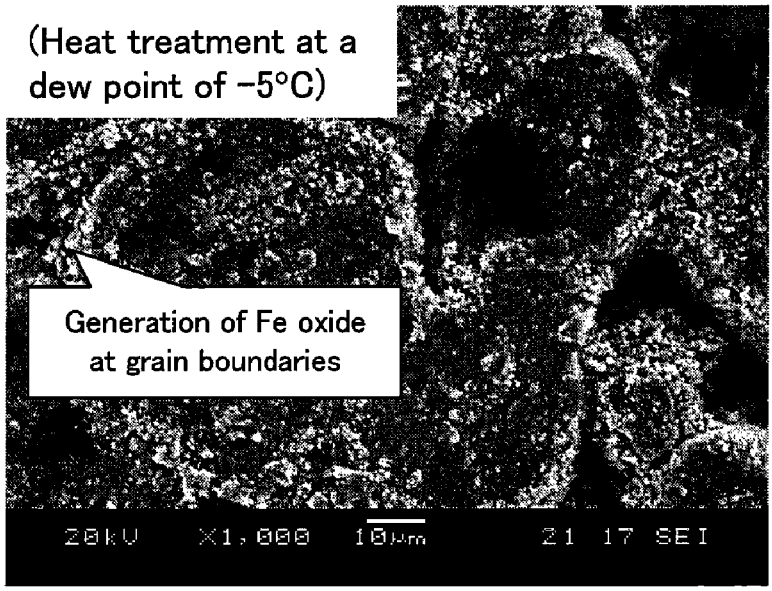

Then, the dust core was wound with wire for closed circuit formation. A 10-kHz alternating current was applied to the formed winding, followed by measurement of inductance and AC resistance with the use of an LCR meter (Agilent Technologies, Inc.; 4284A). FIGS. 3(*a*) and 3(*b*) show the results. In addition, reference intervals shown in FIGS. 3(*a*) and 3(*b*) and the subsequent figures are preferably used for magnetic devices. In addition, the structure of the dust core was observed using a scanning electron microscope (SEM). FIG. 4(*a*) shows the results. The composition of a compound constituting the dust core was analyzed by X-ray photoelectron spectroscopy (XPS) before and after annealing.

Comparative Example 1

A dust core was produced via a step of producing a powder for a dust core, a molding step, and an annealing step, as in the case of Example 1, except that the nitrogen gas dew point in the annealing step was higher than −40° C. (−30° C., −20° C., or −5° C.).

Then, inductance and AC resistance were measured using an LCR meter, as in the case of Example 1. FIGS. 3(*a*) and 3(*b*) show the results. In addition, tissue of the dust core was observed using an SEM as in the case of Example 1. FIG. 4 shows the results.

Result 1 and Discussion

As shown in FIG. 3(*a*), the inductance values obtained in Example 1 fall within the reference interval, while on the other hand, those obtained in Comparative Example 1 do not fall within the reference interval. In addition, as shown in FIG. 3(*b*), the AC resistance values obtained in Example 1 fall within the reference interval, while on the other hand, those obtained in Comparative Example 1 do not fall within the reference interval.

Further, as shown in FIG. 4(*a*), no iron oxide was found at any grain boundary between magnetic particles of the dust core obtained in Example 1. However, the presence of iron oxide was confirmed at a grain boundary between magnetic particles of the dust core obtained in Comparative Example 1.

Based on the above results, it was found that when heat treatment is carried out at a dew point of −40° C. or lower in a nitrogen gas atmosphere in the annealing step, electromagnetic characteristics can be improved. However, when the dew point exceeds −40° C., magnetic characteristics might deteriorate. It is thought that such deterioration could be caused by conduction between magnetic particles in the presence of iron oxide at a grain boundary.

In addition, as a result of composition analysis, the presence of a silicone resin was confirmed in a dust core before annealing. Also, the presence of a silicate compound was confirmed in a dust core after annealing. Based on the results, it is thought that a silicone resin covering a magnetic powder was partially formed into a silicate compound during annealing.

In Examples 2 to 4 and Comparative Examples 2 to 5 described below, annealing of a dust core was conducted under heat treatment conditions shown in FIG. 5. Examples 2 to 4 and Comparative Examples 2 to 5 are described below in detail.

Example 2

A dust core was produced via a step of producing a powder for a dust core, a molding step, and an annealing step, as in the case of Example 1. As shown in FIG. 5, the nitrogen gas dew point in the annealing step was determined to be −60° C. in Example 4. In addition, inductance and AC resistance were measured using an LCR meter, as in the case of Example 1. FIGS. 6(*a*) and 6(*b*) show the results.

Example 3

A dust core was produced via a step of producing a powder for a dust core, a molding step, and an annealing step, as in the case of Example 2, except that the nitrogen gas dew point in a nitrogen gas atmosphere was determined to be −5° C. during heating to 500° C. (corresponding to "Temperature rising A") as shown in FIG. 5. In addition, inductance and AC resistance were measured using an LCR meter, as in the case of Example 1. FIGS. 6(*a*) and 6(*b*) show the results.

Example 4

A dust core was produced via a step of producing a powder for a dust core, a molding step, and an annealing step, as in the case of Example 2, except that the nitrogen gas dew point in a nitrogen gas atmosphere was determined to be −5° C. during cooling under 500° C. (corresponding to "Cooling A") as shown in FIG. 5. In addition, inductance and AC resistance were measured using an LCR meter, as in the case of Example 1. FIGS. 6(*a*) and 6(*b*) show the results.

Comparative Example 2

Figure 5:
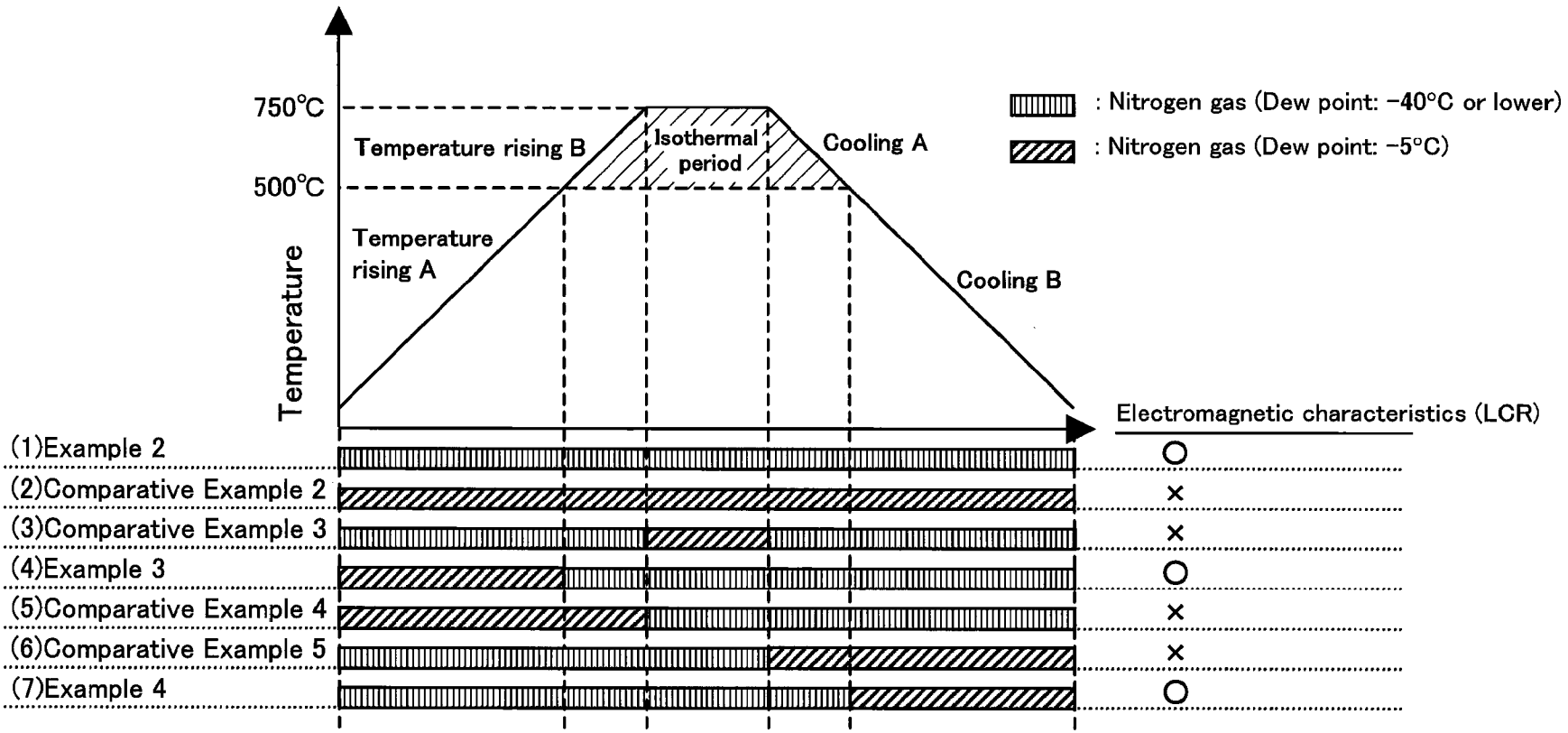
FIG. 5 illustrates the annealing step used in Examples 2 to 4 and Comparative Examples 2 to 5.
Figure 6:
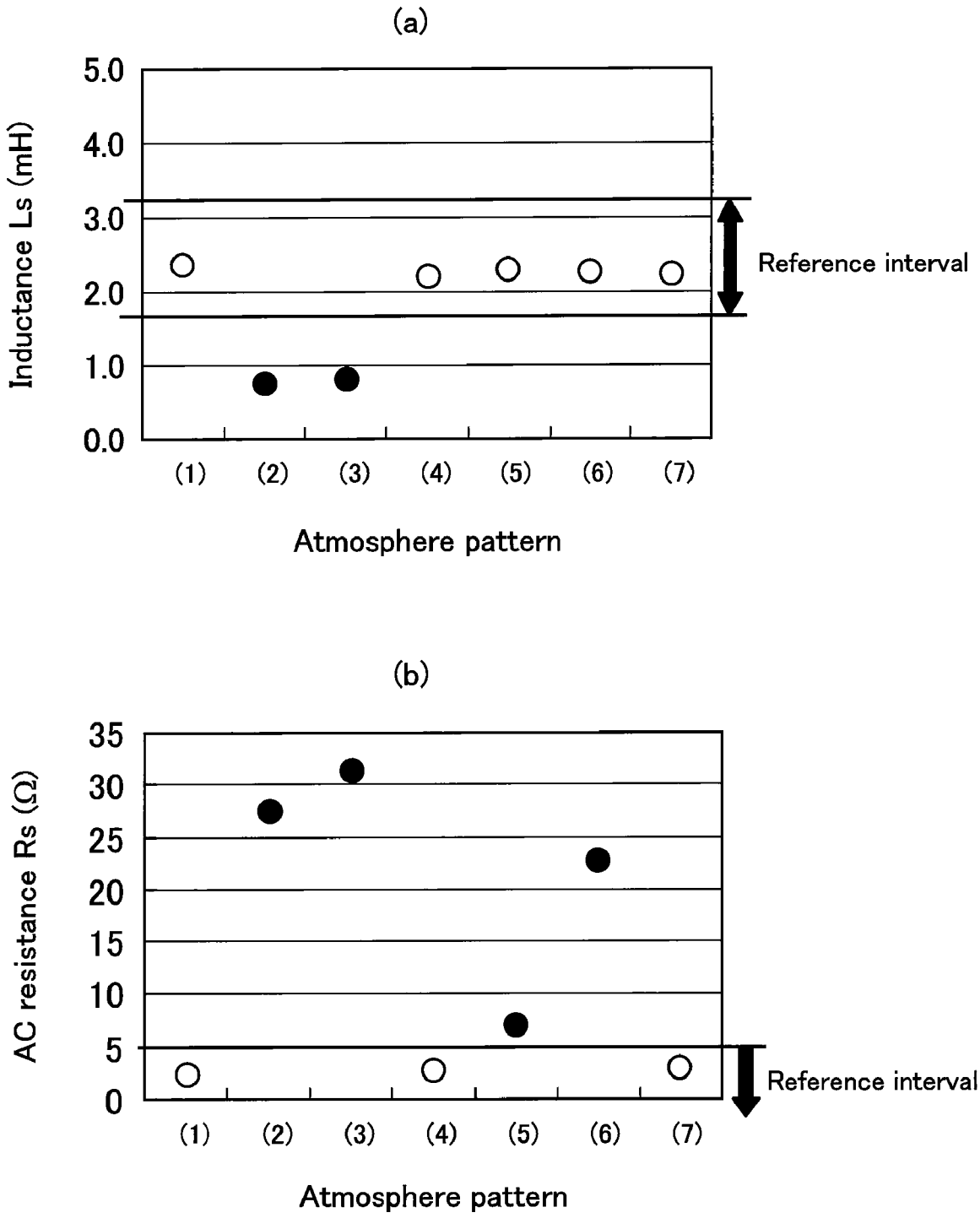
FIGS. 6(*a*) and 6(*b*) each show a chart indicating magnetic characteristics confirmed in Examples 2 to 4 and Comparative Examples 2 to 5.

A dust core was produced via a step of producing a powder for a dust core, a molding step, and an annealing step, as in the case of Example 2, except that the nitrogen gas dew point in a nitrogen gas atmosphere was determined to be −5° C. as shown in FIG. 5. In addition, inductance and AC resistance were measured using an LCR meter, as in the case of Example 1. FIGS. 6(*a*) and 6(*b*) show the results.

Comparative Example 3

A dust core was produced via a step of producing a powder for a dust core, a molding step, and an annealing step, as in the case of Example 2, except that the nitrogen gas dew point in a nitrogen gas atmosphere was determined to be −5° C. during an isothermal period at 750° C. as shown in FIG. 5. In addition, inductance and AC resistance were measured using an LCR meter, as in the case of Example 1. FIGS. 6(*a*) and 6(*b*) show the results.

Comparative Example 4

A dust core was produced via a step of producing a powder for a dust core, a molding step, and an annealing step, as in the case of Example 2, except that the nitrogen gas dew point in a nitrogen gas atmosphere was determined to be −5° C. during heating to 750° C. (corresponding to "Temperature rising A" and "Temperature rising B") as shown in FIG. 5. In addition, inductance and AC resistance were measured using an LCR meter, as in the case of Example 1. FIGS. 6(*a*) and 6(*b*) show the results.

Comparative Example 5

A dust core was produced via a step of producing a powder for a dust core, a molding step, and an annealing step, as in the case of Example 2, except that the nitrogen gas dew point in a nitrogen gas atmosphere was determined to be −5° C. during cooling under 750° C. (corresponding to "Cooling A" and "Cooling B") as shown in FIG. 5. In addition, inductance and AC resistance were measured using an LCR meter, as in the case of Example 1. FIGS. 6(*a*) and 6(*b*) show the results.

Result 2 and Discussion

As shown in FIG. 6(*a*), the inductance values obtained in Examples 2 to 4 fall within the reference interval, while on the other hand, those obtained in Comparative Examples 2 and 3 do not fall within the reference interval. In addition, as shown in FIG. 6(*b*), the AC resistance values obtained in Examples 2 to 4 fall within the reference interval, while on the other hand, those obtained in Comparative Examples 2 to 5 do not fall within the reference interval.

Based on Results 1 and 2 above, it was found that when heat treatment is conducted at 500° C. or higher at a nitrogen gas dew point of −40° C. or lower in a nitrogen gas atmosphere in the annealing step, electromagnetic characteristics can be improved. However, when the dew point exceeds −40° C. at 500° C. or higher, magnetic characteristics might deteriorate, even in a case in which heat treatment is carried out at a heating temperature of less than 500° C. and a dew point of −40° C. or lower. It is thought that such deterioration could be caused by conduction between magnetic particles in the presence of iron oxide at a grain boundary.

Verification tests of Result 1 were conducted in Example 5 and Comparative Example 6 described below.

Example 5

Figure 7:
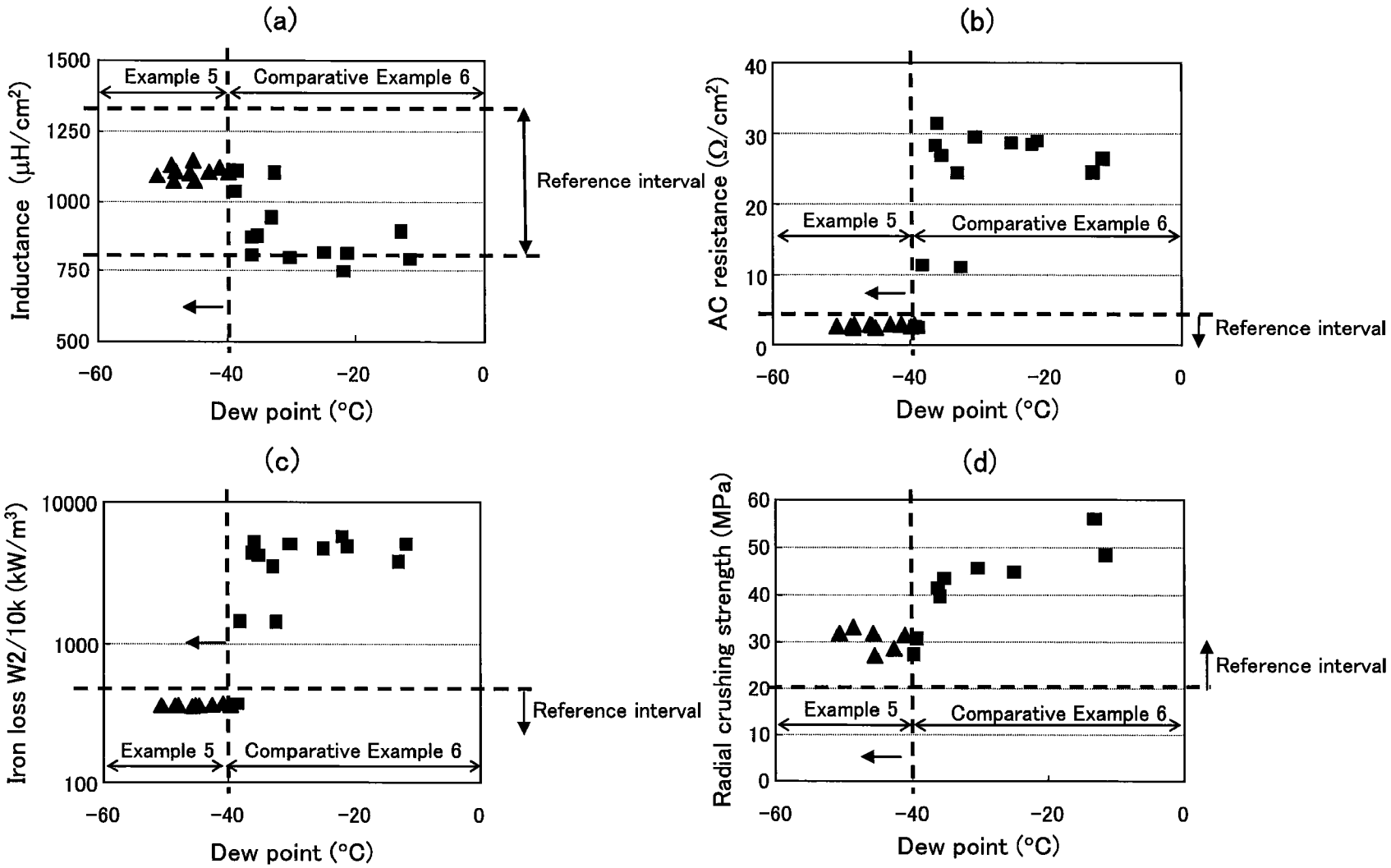
FIGS. 7(*a*) to 7(*d*) each show a chart indicating magnetic characteristics and strength confirmed in Example 5 and Comparative Example 6.

A dust core was produced via a step of producing a powder for a dust core, a molding step, and an annealing step (at a dew point of −40° C. or less), as in the case of Example 1. Then, inductance and AC resistance were measured using an LCR meter, as in the case of Example 1. FIGS. 7(*a*) and 7(*b*) show the results. In addition, iron loss and radial crushing strength were determined. FIGS. 7(*c*) and 7(*d*) show the results.

Comparative Example 6

A dust core was produced via a step of producing a powder for a dust core, a molding step, and an annealing step as in the case of Example 1, except that the dew point temperature in the annealing step was determined to be higher than −40° C.

Then, inductance (inductance per unit area) and AC resistance were measured using an LCR meter, as in the case of Example 1. FIGS. 7(*a*) and 7(*b*) show the results. In addition, the iron loss of each dust core placed in a 0.2 T magnetic field at 10 KHz was determined. FIG. 7(*c*) shows the results. Further, the radial crushing strength of each dust core was determined by a radial crushing strength test method. FIG. 7(*d*) shows the results.

Result 3 and Discussion

As shown in FIG. 7(*a*), the inductance values obtained in Example 5 fall within the reference interval, while on the other hand, those obtained in Comparative Example 6 do not fall within the reference interval. In addition, as shown in FIG. 7(*b*), the AC resistance values obtained in Example 5 fall within the reference interval, while on the other hand, those obtained in Comparative Example 6 do not fall within the reference interval. As shown in FIG. 7(*c*), the iron loss values obtained in Example 5 fall within the reference interval, while on the other hand, those obtained in Comparative Example 6 do not fall within the reference interval. The radial crushing strength values obtained in Example 5 and Comparative Example 6 each fall within the reference interval.

Based on the above results, it was found that when heat treatment is carried out at a dew point of −40° C. or less of a nitrogen gas in a nitrogen gas atmosphere in the annealing step, electromagnetic characteristics (inductance characteristics and AC resistance characteristics) can be improved and iron loss can be reduced. However, when the nitrogen gas dew point exceeds −40° C., magnetic characteristics might deteriorate. In addition, even in a case in which heat treatment was carried out at a nitrogen gas dew point of −40° C. or lower, the radial crushing strength values were successfully maintained within the reference interval.

Example 6

A dust core was produced via a step of producing a powder for a dust core, a molding step, and an annealing step (at a dew point of −40° C. or less) as in the case of Example 1, except that the heat treatment temperature was determined to be 600° C. to less than 900° C. (and specifically 650° C., 700° C., 750°

Figure 8:
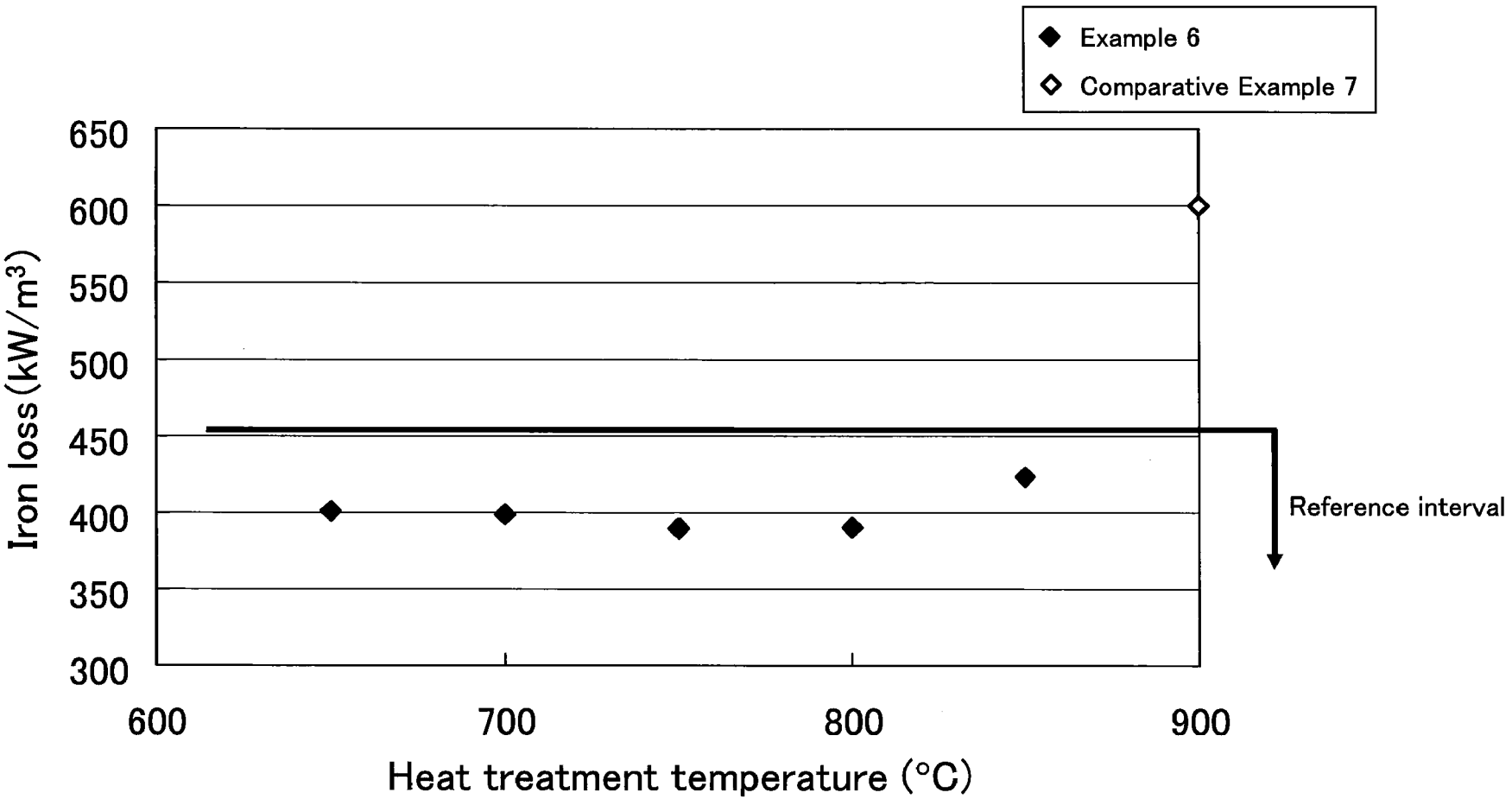
FIG. 8 is a chart showing iron loss determination results obtained in Example 6 and Comparative Example 7.

C., or 850° C.). In addition, iron loss was determined in the manner shown in Example 6. FIG. 8 shows the results.

Comparative Example 7

A dust core was produced via a step of producing a powder for a dust core, a molding step, and an annealing step (at a dew point of −40° C. or less) as in the case of Example 1, except that the heat treatment temperature was determined to 900° C. or higher (and specifically 900° C.). In addition, iron loss was determined in the manner shown in Example 6. FIG. 8 shows the results.

Result 4 and Discussion

As shown in FIG. 8, the iron loss values obtained in Example 6 fall within the reference interval compared to the iron loss value obtained in Comparative Example 7. This is probably because a silicate compound was destroyed at a heating temperature (heat treatment temperature) of 900° C. or higher in Comparative Example 7, resulting in an increase in iron loss.

The embodiments of the present invention are described above in greater detail with reference to the drawings, although the specific configuration of the present invention is not limited thereto. The present invention encompasses various design changes and modifications without departing from the spirit or scope thereof.

The invention claimed is:

1. A method for producing a dust core, which comprises: a step of molding a magnetic powder comprising a powder for a dust core formed with an iron-based magnetic powder coated with a silicone resin into a dust core via compaction; and a step of annealing the dust core via heating so as to cause the silicone resin contained in the dust core to be partially formed into a silicate compound, wherein annealing of the dust core is carried out by heating the dust core under heating conditions of 500° C. to less than 900° C. at a dew point of an inert gas of −40° C. or lower in an inert gas atmosphere in the annealing step.

2. The method according to claim 1, wherein the molding step is carried out under temperature conditions of 120° C. to 150° C.

* * * * *